US005622145A

United States Patent [19]

Hara

[11] Patent Number: 5,622,145

[45] Date of Patent: Apr. 22, 1997

[54] CYLINDER VALVE OPERATING APPARATUS

[75] Inventor: Seinosuke Hara, Atsugi, Japan

[73] Assignee: Unisia Jecs Corporation, Atsugi, Japan

[21] Appl. No.: 574,696

[22] Filed: Dec. 19, 1995

[30] Foreign Application Priority Data

Dec. 21, 1994 [JP] Japan ..... 6-318166

[51] Int. Cl.[6] ..... F01L 13/00

[52] U.S. Cl. ..... 123/90.16; 123/90.39

[58] Field of Search ..... 123/90.15, 90.16, 123/90.17, 90.22, 90.39, 90.44

[56] References Cited

U.S. PATENT DOCUMENTS

| | | | |
|---|---|---|---|
| 5,203,289 | 4/1993 | Hara et al. | 123/90.39 |
| 5,297,516 | 3/1994 | Hara | 123/90.16 |
| 5,415,137 | 5/1995 | Paul | 123/90.22 |
| 5,495,831 | 3/1996 | Paul et al. | 123/90.16 |

FOREIGN PATENT DOCUMENTS

| | | |
|---|---|---|
| 0588336 | 3/1994 | European Pat. Off. . |
| 60-43109 | 3/1985 | Japan . |
| 61-031614 | 2/1986 | Japan . |
| 61-81511 | 4/1986 | Japan . |
| 2273743 | 6/1994 | United Kingdom . |
| 80/00094 | 6/1980 | WIPO . |

*Primary Examiner*—Weilun Lo
*Attorney, Agent, or Firm*—Foley & Lardner

[57] ABSTRACT

A rocker arm which supporting a free cam follower is rotatably supported by an engine-cylinder-mounted rocker shaft to lift cylinder valves against valve springs. The rocker arm and the free cam follower are in cooperation with first and second cams on a camshaft. A lever is supported by the rocker arm and has a locked position wherein the lever is in driving engagement with the free cam follower to provide a positive motion connection between the free cam follower and the rocker arm and a released position wherein the lever is out of driving engagement with the free cam follower to provide relative motion of the free cam follower to the rocker arm. A hydraulic piston and a release spring cooperate with each other to shift the lever between the locked position and the released position. For adjusting the shifting operation in timed relationship with motion of the rocker arm, a latch is arranged to restrain motion of the hydraulic piston when the rocker arm is unlifted and until the rocker arm is lifted.

11 Claims, 9 Drawing Sheets

CYLINDER VALVE OPERATING APPARATUS

BACKGROUND OF THE INVENTION

The present invent ion relates to a cylinder valve operating apparatus for an internal combustion engine.

U.S. Pat. No. 5,297,516 issued to HARA on Mar. 29, 1994 discloses a cylinder valve operating apparatus. This known apparatus comprises a camshaft with at least one set of cams including a first cam and a second cam, and a rocker arm supported by a rocker shaft and driven by the first cam for rotatable motion about the rocker shaft. A free cam follower is supported by the rocker arm and driven by the second cam for rotatable motion relative to the rocker arm. A lever is supported by the rocker arm and has a locked position wherein the lever is in driving engagemeat with the free cam follower to provide a positive motion connection between the free cam follower and the rocker arm and a released position wherein the lever is out of driving engagement with the free cam follower to provide relative motion of the free cam follower to the rocker arm. A hydraulic piston and a lever release spring cooperate with each other to control a shift of the lever between the locked position and the released position.

An object of the present invention is to improve the apparatus of the above type such that fail-free and noiseless shift of the lever between the locked position and the released position is ensured.

SUMMARY OF THE INVENTION

According to the present invention, there is provided a cylinder valve operating apparatus comprising:

- a camshaft with at least one set of cams including a first cam and a second cam;
- a rocker shaft;
- a rocker arm supported by said rocker shaft and driven by said first cam for rotatable motion about said rocker shaft;
- a free cam follower supported by said rocker arm and driven by said second cam for rotatable motion relative to said rocker arm;
- a lever supported by said rocker arm, said lever having a locked position wherein said lever is in driving engagement with said free cam follower to provide a positive motion connection between said free cam follower and said rocker arm and a released position wherein said lever is out of driving engagement with said free cam follower to provide relative motion of said free cam follower to said rocker arm;
- means for shifting said lever between said locked position and said released position; and
- means for adjusting operation of said shifting means in timed relationship with motion of said rocker arm.

DETAILED DESCRIPTION OF THE INVENTION

Figure 1:
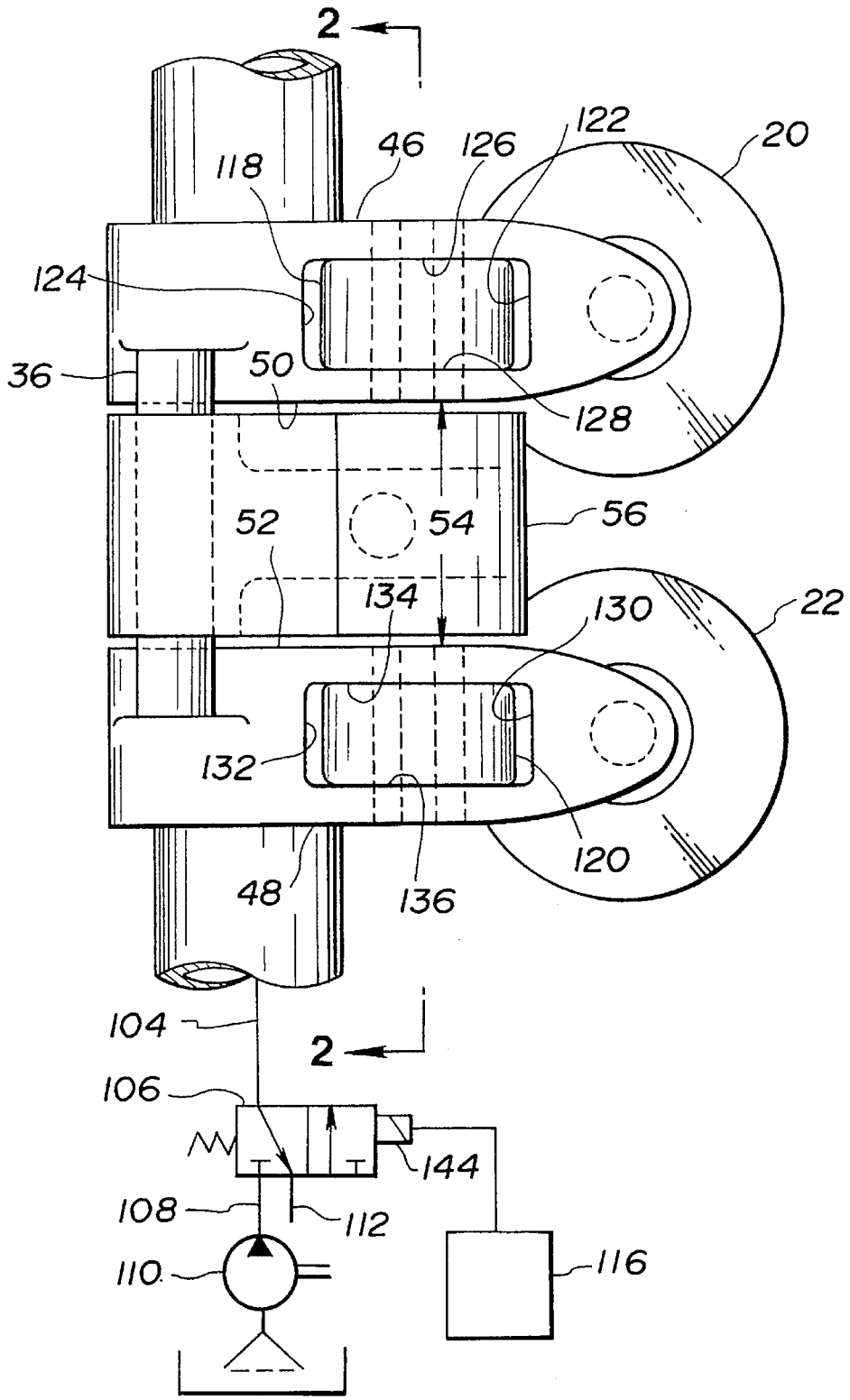
FIG. 1 is a fragmentary top plan view of a cylinder head of an internal combustion engine with a camshaft removed.

Referring to the accompanying drawings, like reference numerals and characters are used throughout all of the Figures to designate like or similar parts and portions. Referring to FIGS. 1 to 13, the first embodiment is described. In this embodiment, the invention is embodied in a cylinder valve operating apparatus of an internal combustion engine having two poppet type cylinder valves per each cylinder, e.g., two intake valve or exhaust valves, which are designed to perform the same function.

Figure 2:
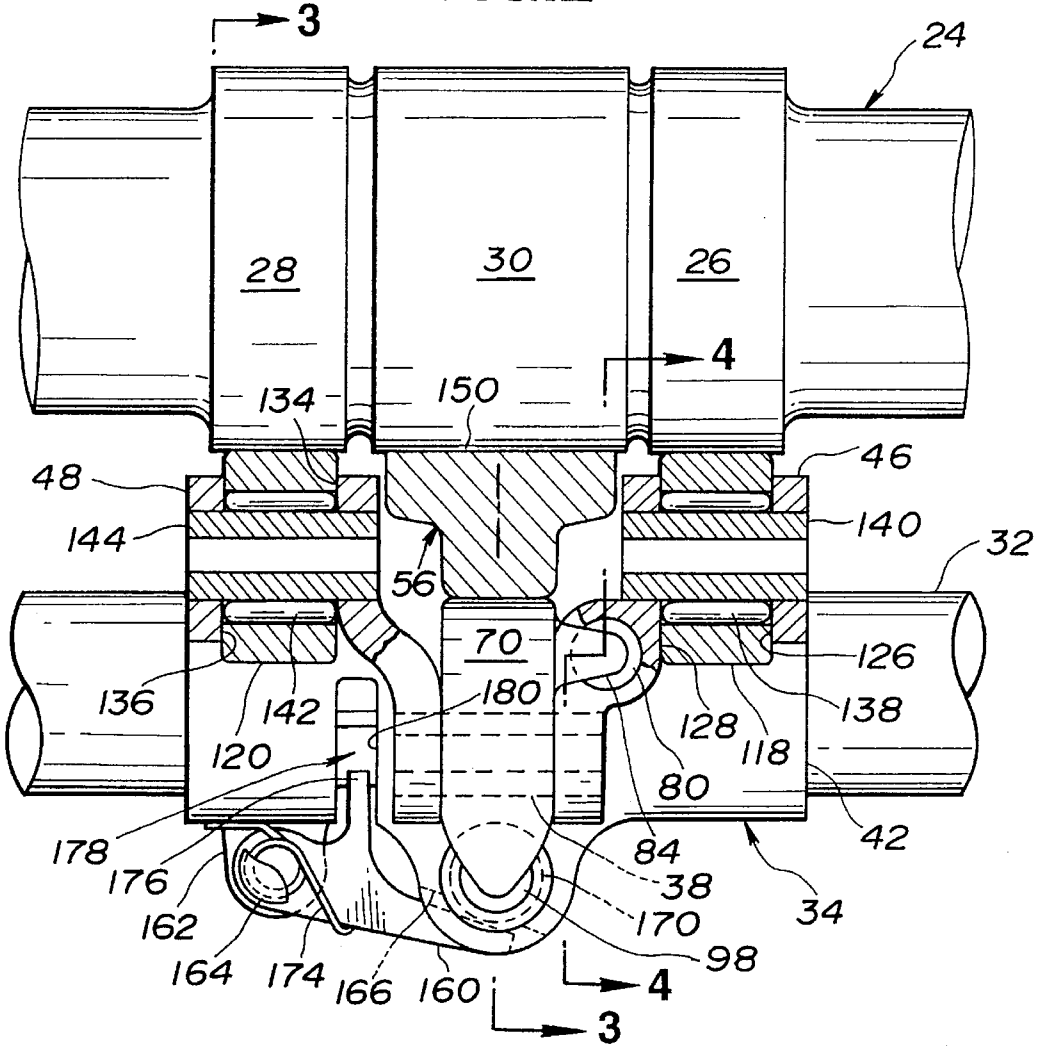
FIG. 2 is a front elevation of a first embodiment of a cylinder valve operating apparatus according to the present invention, partially sectioned through the line 2—2 of FIG. 1.

In FIG. 1, there are shown two intake valves 20 and 22 for each of the cylinders of the engine of the overhead camshaft type. The cylinder valve operating apparatus comprises a camshaft 24 rotatably supported by a cylinder head of the engine in the conventional manner. The camshaft 24 has or is formed with at least one set of cams, each set including at least one first cam and a second cam. As best seen in FIG. 2, in this embodiment, there are a pair of axially spaced first came 26 and 28 and a second cam 30 disposed between the pair of first cams 26 and 28. The pair of first cams 26 and 28 are identical in profile and confined within profile of the second cam 30 as readily seen from FIG. 3. The first cams 26 and 28 provide a valve lift lower than a valve lift provided by the second cam 30.

A rockers shaft 32 is mounted to the cylinder head of the engine the and rotatably supports a rocker arm 34. The rocker shaft 32 and the camshaft 24 are arranged in parallel.

Figure 3:
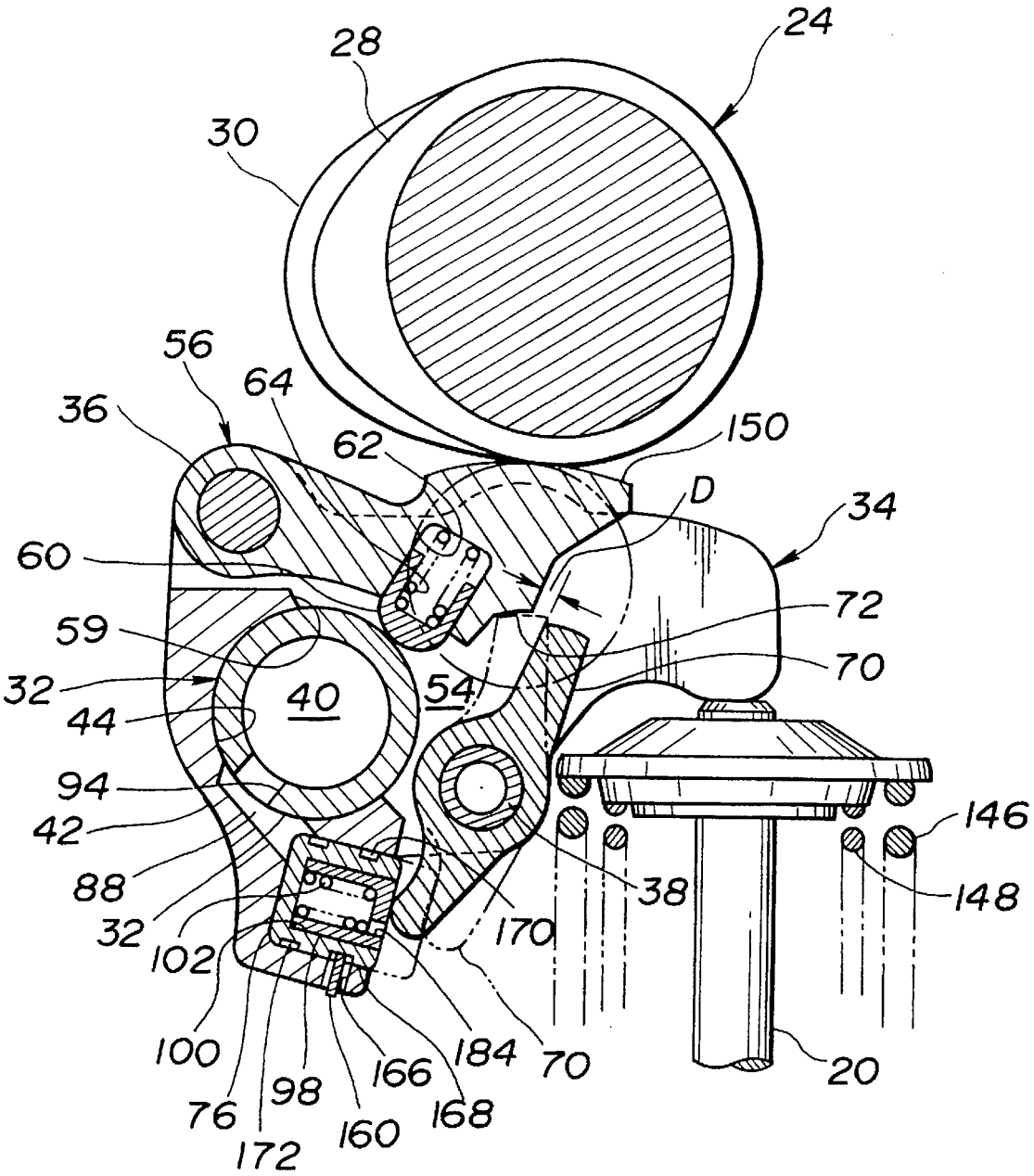
FIG. 3 is a section taken through the line 3—3 of FIG. 2, showing, in the fully drawn line, a lever in a released position and, in the phantom line, the lever in a locked position.

As best seen in FIG. 3, the rocker arm 34 has a sub-rocker shaft 36 and a pin 38. The sub-rocker shaft 36 and the pin 38 extend in parallel with respect to the rocker shaft 32 and disposed around the rocker shaft 32. The rocker shaft 32 is hollowed to define an axial passage 40.

Figure 4:
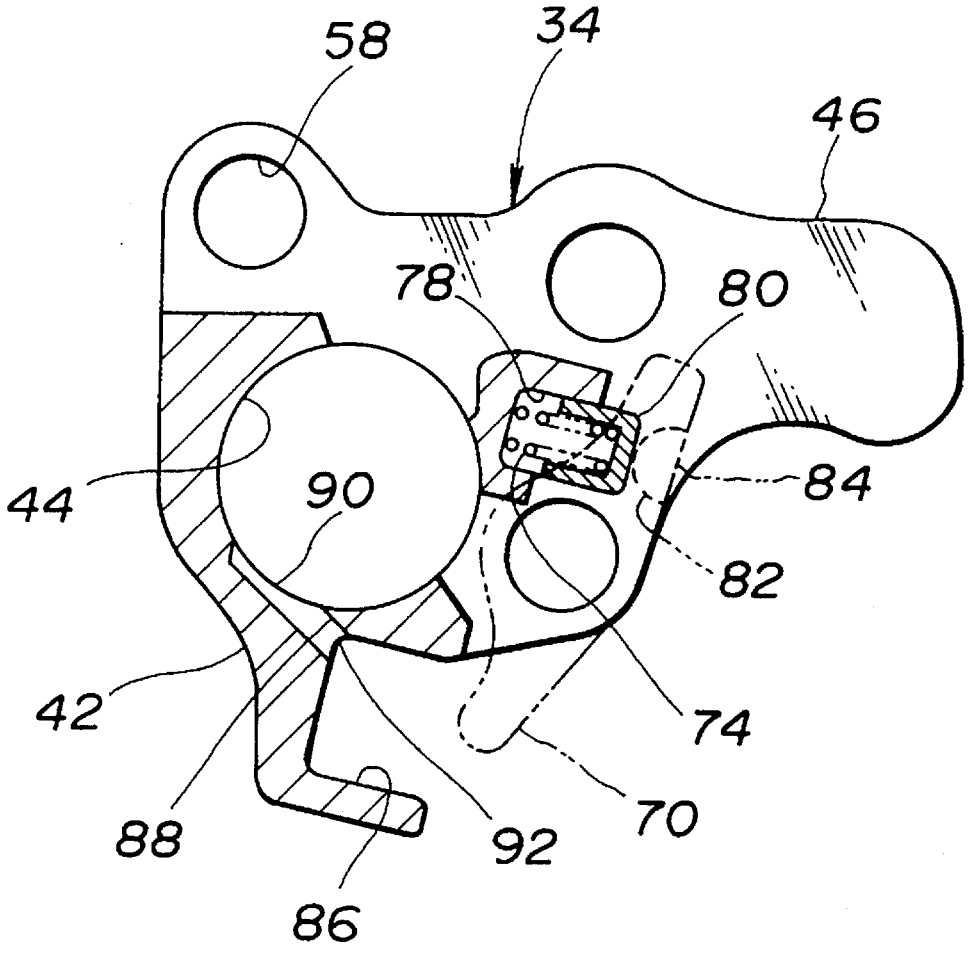
FIG. 4 is a section taken through the line 4–4 of FIG. 2 with unnecessary parts removed to show the contour of a rail portion of a rocker arm and a release spring biasing a lever.

As seen in FIGS. 3 and 4, the rocker arm 34 includes a base portion 42 formed with a bore 44 rotatably receiving the rocker shaft 32. Referring to FIGS. 1 and 2, the rocker arm 34 has a pair of rail portions 46 and 48 extending from the base portion 42 for driving engagement with stems of the two valves 20 and 22, respectively. The pair of rail portions 46 and 48 are connected by the base portion 42 and have spaced and opposed wall structures 50 and 52 defining therebetween a space 54. The wall structures 50 and 52 are bridged by the pin 38.

Disposed in the space 54 is a free cam follower 56 rotatably supported by the sub-rocker shaft 36. The sub-rocker shaft 36 has opposite end portions received in bores formed through the rail portions 46 and 48, respectively, only the bore of the rail portion 46 being shown at 58 in FIG. 4.

As best seen in FIG. 3, the base portion 42 of the rocker arm 34 is formed with an opening 59 through which the rocker shaft 32 projects into the space 54. In contact with that portion of the rocker shaft 32, which is exposed to the space 54, is a prop 60. The prop 60 supports the free cam follower 56 in spaced relationship with the rocker shaft 32. The prop 60 is retractable to provide a lost motion connection between the free cam follower 56 and the rocker shaft 32. In detail, the prop 60 is slidably received in a bore 62 of the free cam follower 56 and a spring 64 acts between the prop 60 and the blind end of the bore 62 for biasing the prop 60 against the rocker shaft 32.

Referring to FIGS. 2 and 3, a lever 70 is rotatably supported by the pin 38 of the rocker arm 34. The lever 70 has a locked position as illustrated in phantom line in FIG. 3 and a released position as illustrated by fully drawn line in FIG. 3. In the locked position, the lever 70 engages a cavity 72 of the free cam follower 56 and is in driving engagement with the free cam follower 56 to provide a positive motion connection between the free cam follower 56 and the rocker arm 34 during motion of the free cam follower 56 toward the rocker shaft 32. It will be noted that the motion is transmitted to the pin 38 through the lever 70 (see FIG. 2) and then to the wall structures 50 and 52 of the rail portions 46 and 48. In the released position, the lever 70 is out of driving engagement with the free cam follower 56 to provide a relative motion of the free cam follower 56 to the rocker arm 34. During this relative motion of the free cam follower 56 to the rocker arm 34, the spring 64 allows reciprocating motion of the prop 60.

For shifting the lever 70 between the locked position and released position, there are provided a release spring 74 (see FIG. 4) for biasing the lever 70 toward the released position and a piston 76. As best seen in FIGS. 2 and 4, the release spring 74 is disposed in a recess or bore 78 with which the wall structure 50 is formed. The bore 78 is located at a portion radially spaced from the axis of rotation of the lever 70 in a direction toward the free cam follower 56. Slidably disposed in the bore 78 is a cup-shaped spring retainer 80. The release spring 74 acts between the blind end of the bore 78 and the retainer 80. Under the bias of the release spring 74, the retainer 80 is kept in slidable engagement with a curved wall 82 of an ear 84 of the lever 70. The ear 84 extends in a direction generally parallel to the axis of rotation of the lever 70 from the lateral side of the lever 70. The piston 76 is slidably disposed in a cylindrical bore 86 with which the base portion 44 of the rocker arm 34 is formed. The cylindrical bore 86 is located at a portion radially spaced from the axis of rotation of the lever 70 in a direction away from the free cam follower 56. The base portion 92 of the rocker arm 34 is formed with a passage 88 establishing fluid communication between a port 90 opening to the bore 44 and a port 42 opening to the cylindrical bore 86. The rocker shaft 32 is formed with a radial port 94 communicating with the axial passage 40 extending through the rocker shaft 32. The port 90 extends such that the radial port 94 of the rocker shaft 32 always communicates with the cylindrical bore 86 through the passage 88. The piston 76 defines within the cylindrical bore 86 a chamber 96 to which the port 92 is open. The piston 76 is designed to move in a first direction tending to project out of the cylindrical bore 86 in response to pressure build-up within the chamber 96 owing to supply of hydraulic fluid thereto. It is to be noted that the piston 76 is out of contact with the lever 60.

In order to transmit motion of the piston 76 in the first direction to the lever 70 to move the lever 70 toward the locked position against the release spring 74, a cup 98 is slidably received in a blind bore 100 with which the piston 76 is formed and a spring 102 is mounted within the blind bore 100 and acts between the blind end of the bore 100 and the cup 98 to keep the cup 98 in contact with the lever 70. The setting is such that the release spring 74 imparts to the lever 70 moment greater in magnitude than counter moment imparted to the lever 70 by the spring 102. As discussion proceeds, it will be noted that the cup 98 and the spring 102 cooperate with each other to assist the piston 76 to move in a second direction opposite to the first direction subsequent to the motion of the piston 76 in the first direction.

Referring to FIG. 1, the axial passage 40 is connected through a schematically illustrated passage means 104 to a solenoid operated control valve 106, which operates to supply hydraulic fluid from a gallery 108 connected to a pump 110 to the axial passage 40 or to discharge hydraulic fluid from the axial passage 40 to a discharge line 112. The solenoid operated control valve 106 has a solenoid 144. Electric current passing through the solenoid 144 is controlled by a control unit 116. They cooperate with each other to control supply of hydraulic fluid to and discharge thereof from the chamber 96 defined within the cylindrical bore 86.

As viewed in FIG. 1, the rail portions 46 and 48 are formed with rectangular openings, respectively, receiving rollers 118 and 120, respectively. The rail portion 46 has two spaced side walls 122 and 124 and two axially spaced, with respect to the axis of the rocker shaft 32, end walls 126 and 128. The end walls 126 and 128 cooperate with the side walls 122 and 124 to define the rectangular opening of the rail portion 46. Similarly, the rail portion 48 has two spaced side walls 130 and 132 and two axially spaced, with respect to the axis of the rocker shaft 32, end walls 134 and 136. The end walls 134 and 136 cooperate with the side walls 130 and 132 to define the rectangular opening of the rail portion 48.

Referring to FIG. 2, the roller 118 is rotatably supported via needle bearing 138 by a bearing carrier 140 having one and opposite ends fixedly inserted into the end walls 126 and 128, respectively. Similarly, the roller 120 is rotatably supported via needle bearing 142 by a bearing carrier 144 having one and opposite ends fixedly inserted into the end walls 134 and 136, respectively. The rollers 118 and 120 are kept in contact with the first cams 26 and 28 owing to valve springs 146 and 148 for the intake valve 20 (see FIG. 3) and valve springs, not shown, for the intake valve 22. Referring to FIG. 3, the free cam follower 56 has a curved crown 150 kept in contact with the second cam 30 due to the spring 64 of the prop 60. Thus, during rotation of the camshaft 24, the rocker arm 34 is driven to pivot by the first cams 26 and 28, while the free cam follower 56 is driven pivot by the second cam 30 to lift the intake valves 20 and 22 in accordance with the cam profile of the first cams 26 and 28 when the lever 70 is in the released position thereof. As shown in FIG. 3, there is provided a clearance D between the free cam follower 56 and the lever 70 to avoid interference therebetween during motion of the free cam follower 56 relative to the rocker arm 34 when the lever 70 is in the released position. When the lever 70 is in the locked position thereof, the free cam follower 56 is driven or lifted by the second cam 30 in unitary motion with the rocker arm 34 to lift the intake valves 20 and 22 in accordance with the cam profile of the second cam 30. The cam profile of the first cams 26 and 28 is designed to meet demands during engine operation at low speeds, while the cam profile of the second cam 30 is designed to meet demands during engine operation at high speeds.

Figure 10:
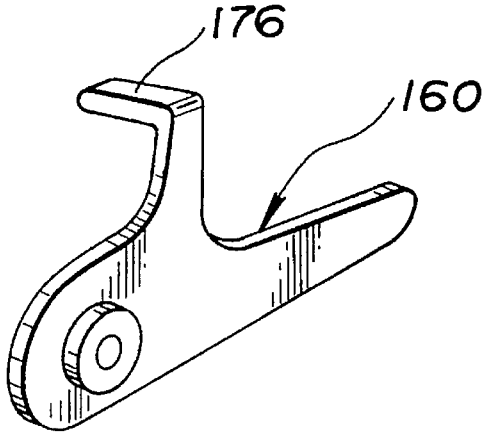
FIG. 10 is a perspective view of the latch with the cam follower finger.

In order to adjust operation of the piston 76 in timed relationship with motion of the rocker arm 34, there is provided a mechanism to restrain motion of the piston 76 when the rocker arm 34 rests. In this embodiment, the rocker arm 34 rests when the rollers 118 and 120 are in contact with base circle portions of the first cams 26 and 28, respectively. As best seen in FIG. 2, a latch lever 160 is supported by the rocker arm 34. The base portion 42 has a downwardly extending portion 162 into which a headed pin 164 Is embedded. The latch lever 160 of the shape as shown in FIG. 10 is rotatably supported by the headed pin 162 and arranged to enter a slot 166 with which the rocker arm 34 is formed. The slot 166 opens to the cylindrical bore 86 receiving the piston 76. The piston 76 has a cylindrical peripheral wall 168 covering the slot 166. The piston 76 has within the cylindrical wall 168 spaced first and second circumferential grooves 170 and 172 adapted to receive the latch 160. The first and second grooves 170 and 172 are spaced along a direction in which the piston 76 moves. The setting is such that the latch 160 enters the first groove 170 to prevent motion of the piston 76 in the first direction from a recessed position thereof as illustrated in FIG. 3, while the latch 160 enters the second groove 172 to prevent motion of the piston 76 in the second direction from a protruded position thereof. A latch spring 174 is mounted around the headed pin 164 between the head of the pin 164 and the latch 160. The latch spring 174 has one end bearing against the adjacent wall of the rocker arm 34 and the opposite end anchoring the latch 160 to bias the latch 160 into engagement with the cylindrical peripheral wall 168 of the piston 76, while keeping a cam follower finger 176 in slidable contact with a latch release cam 178 (see FIGS. 2 and 8). The latch 160 is formed with the cam follower finger 176 cooperating with the latch release cam 178 with which the rocker shaft 32 is formed. The rocker arm 34 is formed with an opening 180 (see FIG. 8) through which the cam follower finger 176 enters into cooperation with the latch release cam 178.

Figure 8:
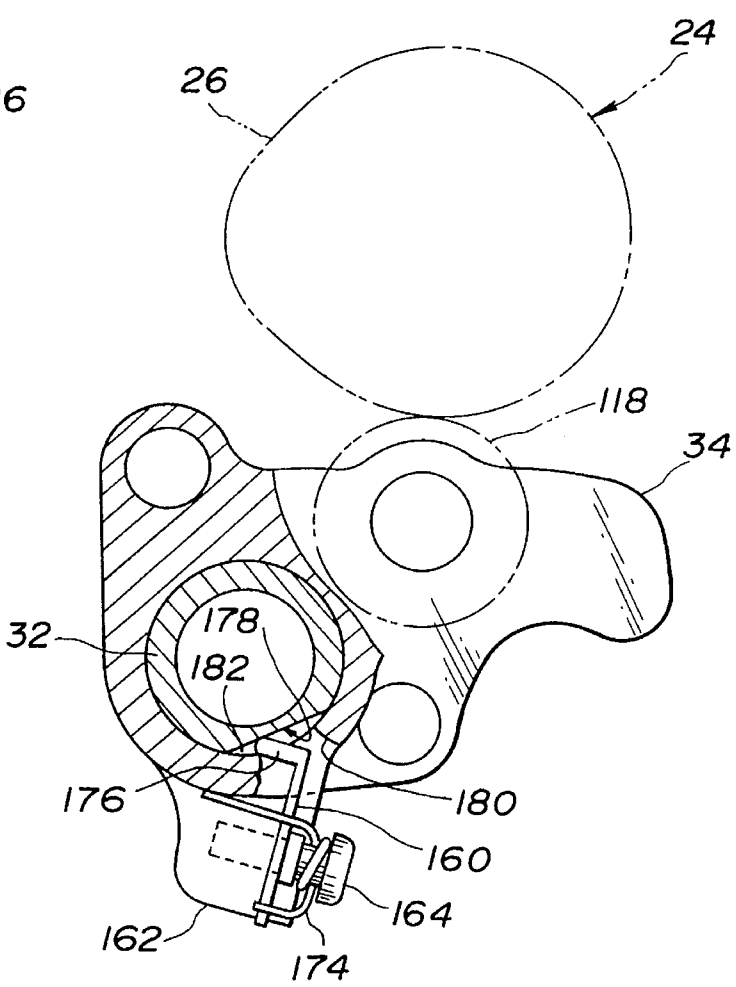
FIG. 8 is similar to FIG. 7 but partially sectioned through a different plane to show the position of a cam follower finger of the latch relative to a latch release cam with which a rocker shaft is formed.
Figure 9:
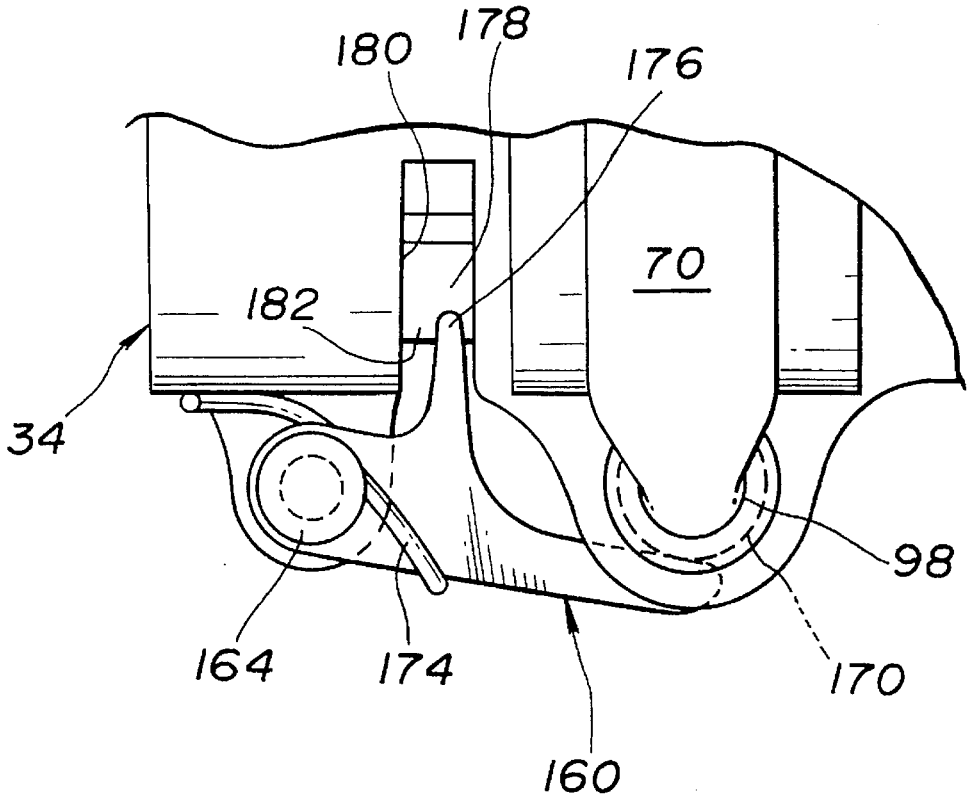
FIG. 9 is an enlarged fragmentary view of FIG. 2, showing the latch entering the groove of the piston.
Figure 12:
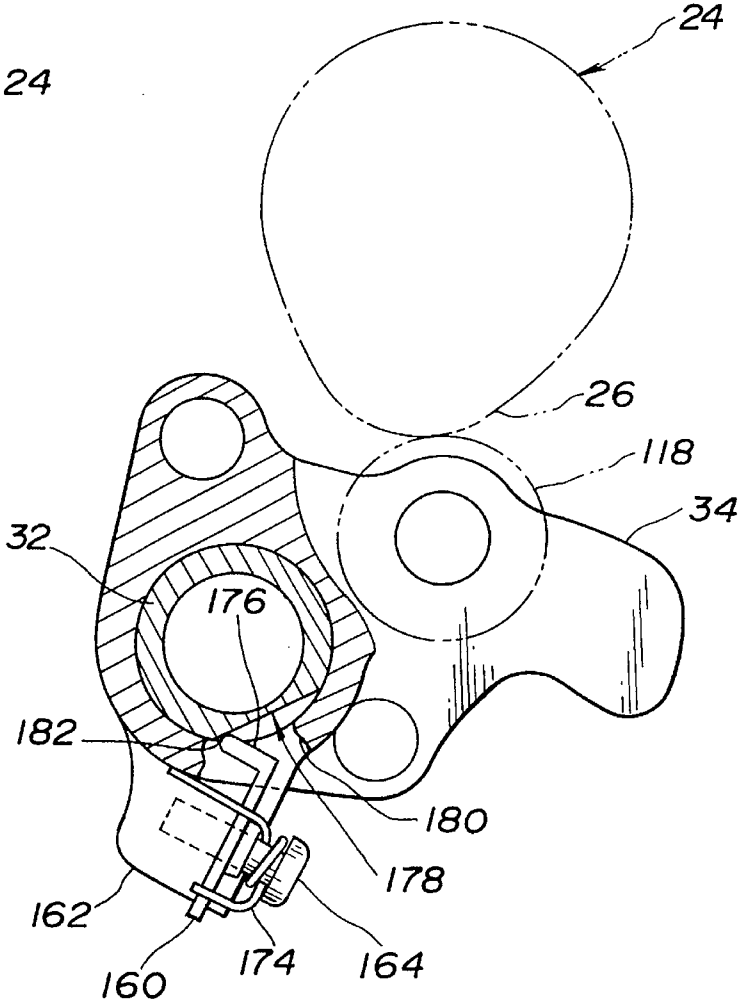
FIG. 12 is similar to FIG. 11 but partially broken away to show the position of the cam follower finger of the latch relative to the latch release cam.
Figure 13:
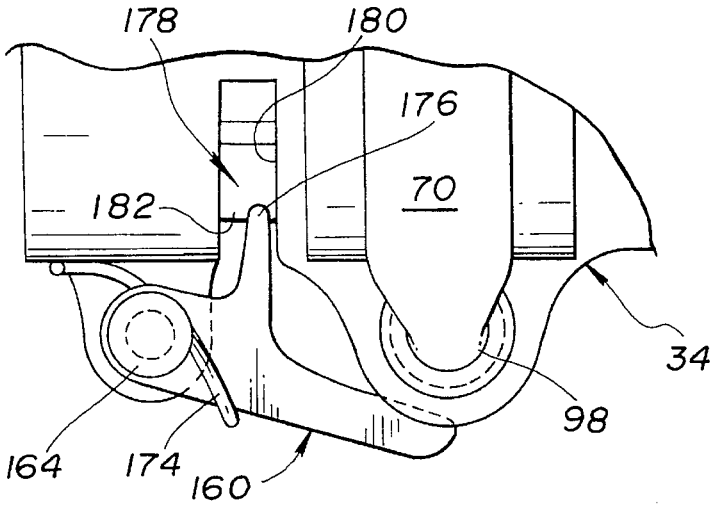
FIG. 13 is an enlarged fragmentary view of FIG. 2, showing the latch in the released position thereof wherein the latch is disengaged from the piston.

As is readily seen from FIGS. 12 and 13 in comparison with FIGS. 8 and 9, the latch release cam 178 has an elevated portion 182 remotest from an axis of the rocker shaft 32 about which the rocker arm 34 rotates, and the elevated portion 182 comes into contact with the cam follower finger 176 when the rocker arm 34 pivots to the position illustrated in FIG. 12 to move the latch 160 to a latch released position as illustrated in FIG. 13. In the latch released position, the latch 160 is disengaged from the first and second grooves 170 and 172.

Figure 6:
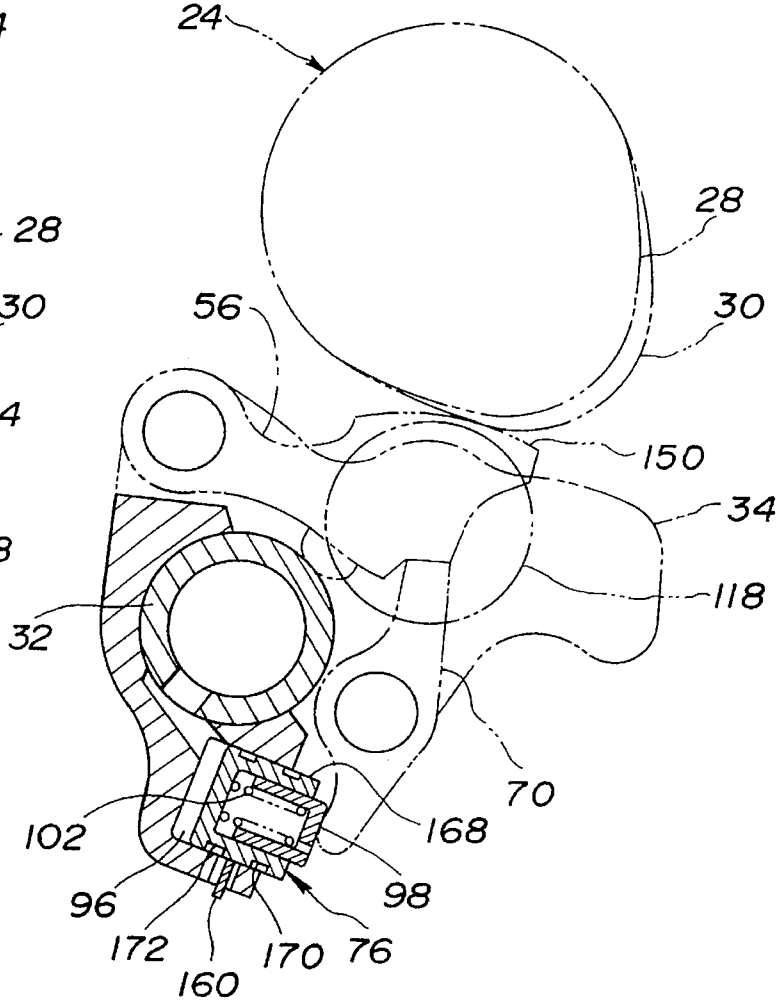
FIG. 6 is a similar view to FIG. 5 showing the position of parts when the lever is about to leave the locked position thereof toward the released position thereof.

Referring back to FIG. 3, the cup 98 is formed with an air vent hole 184 communicating with the blind ended bore 100 for smooth movement of the cup 98 relative to the piston 76. FIG. 6 illustrates the state where the rocker arm 34 pivots and the lever 70 is firmly engaged with the free cam follower 56 due to the action of the valve springs 148 and 146 to hold the locked position thereof, while discharge of hydraulic fluid from the chamber 96 has begun. In this state, the spring 102 assists the piston 76 to move in the second direction toward the recessed position thereof.

Figure 7:
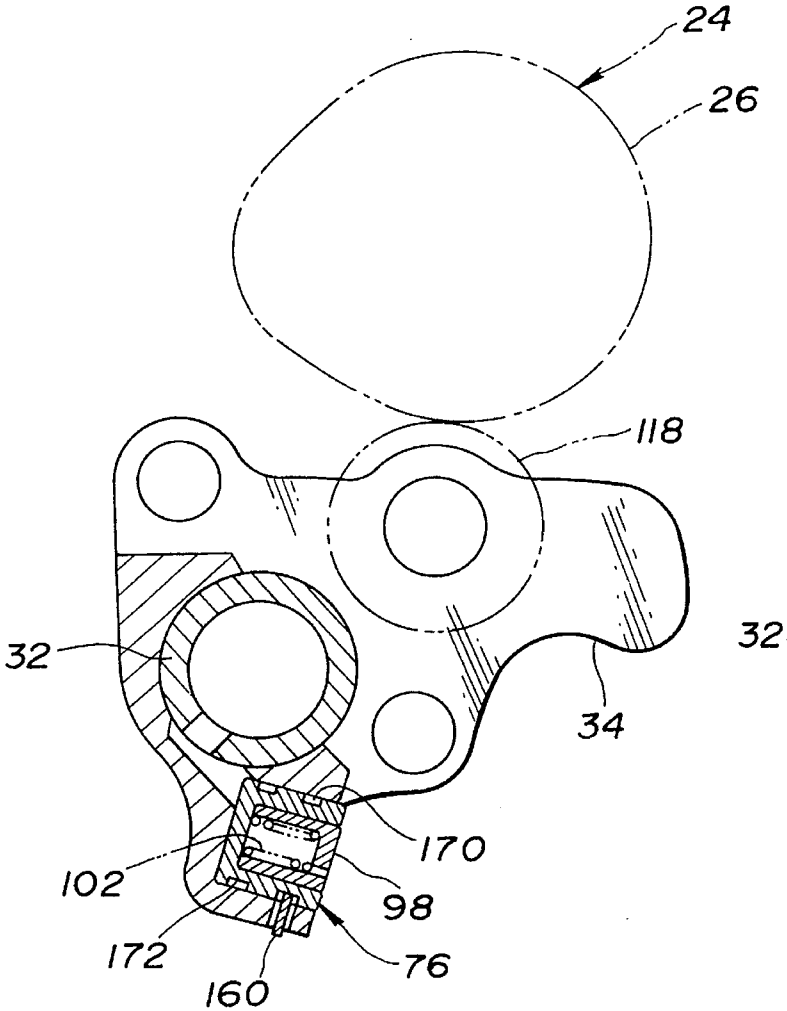
FIG. 7 is similar to FIG. 3 with the lever and a free cam follower removed to show a latch entering a groove of a hydraulic piston to limit motion of the piston, defining a recessed position of the piston.
Figure 11:
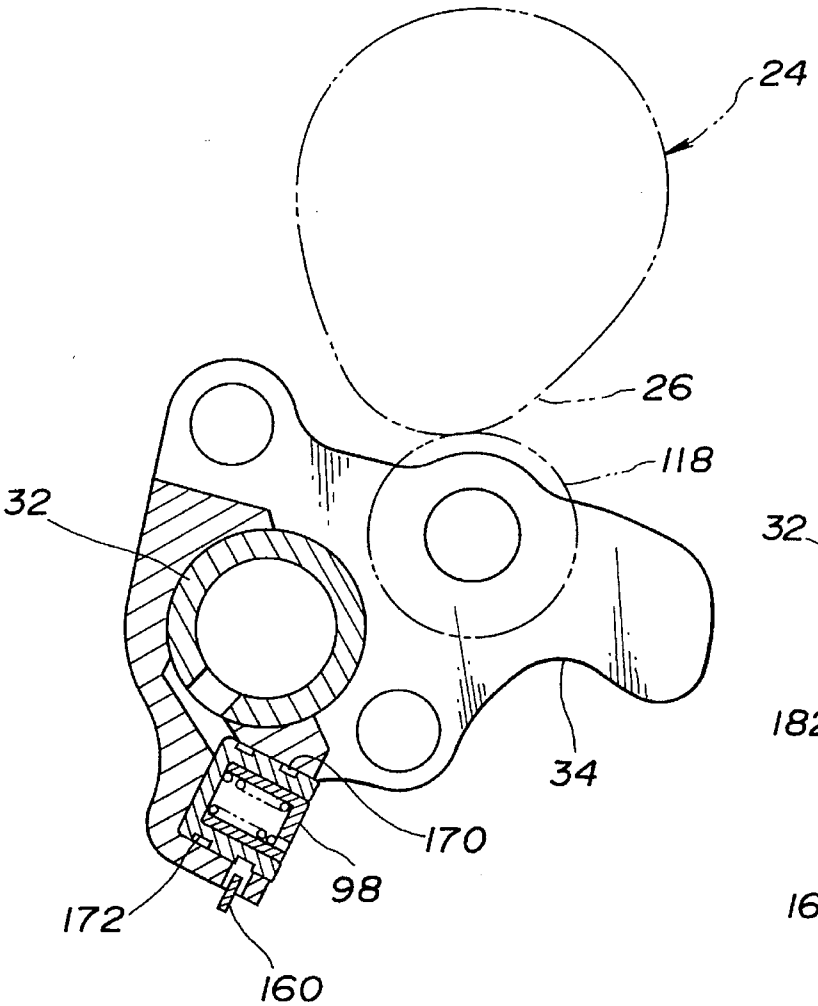
FIG. 11 is a similar view to FIG. 7 showing the position of parts when the rocker arm pivots to cause the latch to assume a released position thereof.

Let us now assume that the control unit 116 instructs deenergization of the solenoid 144 to cause the solenoid operated control valve 106 to discharge hydraulic fluid from the chamber 96 in response to demands during low speed operation of the engine. In this case, the piston 76 stays in the recessed position thereof as illustrated in FIGS. 3, 7 and 11 during rotation of the camshaft 24. During rotation of the camshaft 24, the rocker arm 34 rotates clockwise from the rest position as illustrated in FIGS. 7, 8 and 9 to the pivoted position as illustrated in FIGS. 11, 12 and 13, causing the cam follower finger 176 to move to the elevated portion 182 of the latch release cam 178. This causes movement of the latch 160 to the released position as illustrated in FIG. 13. In the released position, the latch 160 is disengaged from the first groove 170 of the piston 76. As will be readily seen from the preceding description in connection with FIGS. 7 to 9 and 11 to 13, the latch 160 is engaged in the first groove 170 to prevent motion of the piston 76 in the first direction from the recessed position thereof until the rocker arm 34 pivots to move the latch 160 to the released position thereof where the latch 160 is disengaged from the first groove 170.

Nextly, let us assume that the control unit 116 instructs the solenoid 114 to cause the solenoid operated control valve 106 to supply hydraulic fluid to the chamber 96 in responses to demands during high speed operation of the engine. Let us also assume that the lever 70 is in the locked position as illustrated by the phantom line in FIG. 3 and thus the piston 76 is in the projected position. In the projected position of the piston 70, the second groove 172 of the piston 76 is in registry with the slot 166. Thus, the latch 160 is engaged in the second groove 172 to prevent motion of the piston 76 in the second direction from the protruded position until the rocker arm 34 is lifted to move the latch 160 to the released position thereof where the latch 160 is disengaged from the second groove 172.

Figure 5:
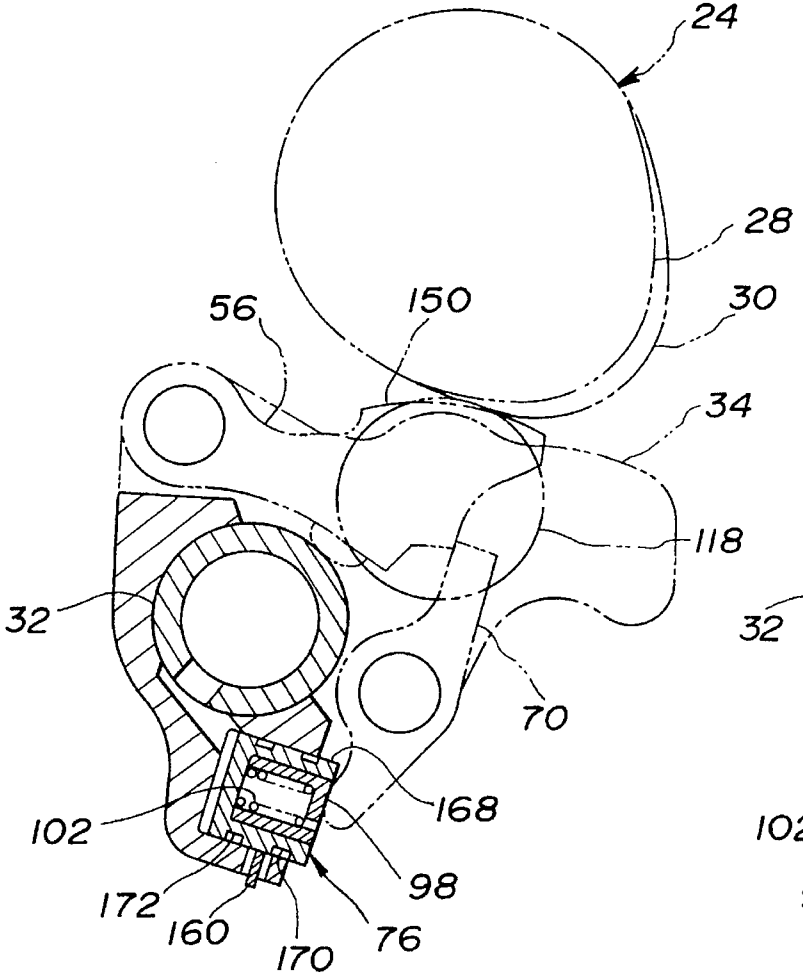
FIG. 5 is a similar view to FIG. 3 showing the position of parts when the lever is about to come into the locked position thereof.

Referring to FIGS. 5, 7, and 11, let us now consider a shift from the released position of the lever 70 as illustrated by the fully drawn line in FIG. 3 to the locked position thereof as illustrated by the phantom line in FIG. 3. Let us now assume that the camshaft 24 rotates counterclockwise in these Figures and there occurs supply of hydraulic fluid to the chamber 96 immediately after the camshaft 24 has rotated past an angular position thereof as illustrated in FIG. 7. During rotation of the camshaft 24 from the angular position as illustrated in FIG. 7 to an angular position immediately before an angular position as illustrated in FIG. 11, the latch 160 prevents motion of the piston 76 in the first direction. Upon and immediately after the angular position as illustrated in FIG. 11, the latch 160 is disengaged from the first groove 170, allowing the piston 76 to move in the first direction until the lever 70 closes the clearance into abutting engagement with the free cam follower 56 as illustrated in FIG. 5. In this angular position, the latch 160 rides on the cylindrical peripheral wall 168 of the piston 76. Immediately after the angular position as illustrated in FIG. 5, the rocker arm 34 rests again and the lever 70 engages in the cavity 72 of the free cam follower 56 due to further movement of the piston 76 from the illustrated position in FIG. 5 to the projected position thereof. When the lever 70 engages in the cavity 72 to take the locked position thereof, the piston 76 takes the projected position thereof and the latch 160 enters the second groove 172 to engage therein.

It will be noted from the proceeding description that the piston 76 is held in the recessed position thereof even if there has occurred a pressure build-up in the chamber 96 when the rocker arm 34 pivots and until the rocker arm 34 is lifted, but allowed to move to the projected position thereof to urge the lever 70 into engagement in the cavity 72 of the free cam follower 56 immediately after the rocker arm 34 rests again.

It will also be noted that the spring 102 is compressed to provide the positive motion connection between the piston 76 and the lever 70 during the motion of the piston 76 in the first direction since the spring 102 is overwhelmed by the release spring 74.

Let us consider a reverse shift from the locked position of the lever 70 to the released position thereof. Let us assume that there occurs discharge of hydraulic fluid from the chamber 96 when the rocker arm 34 rests. Since the latch 160 engages in the second groove 172, the piston 76 is held in the projected position until the latch 160 is lifted to the released position thereof. FIG. 6 shows the position of parts immediately after the latch 160 has lifted to the released position thereof. In the position as illustrated in FIG. 6, the latch 160 has been disengaged from the second groove 172 to allow the piston 76 to move in the second direction toward the recessed position thereof owing to the action of the spring 102, while the lever 70 is held in the locked position thereof owing to firm engagement with the free cam follower 56 under the bias of the valve springs 146 and 148. The latch 160 enters the first groove 170 after the piston 76 has moved to the recessed position thereof. When subsequently the rocker arm 34 rests again, the lever 70 is disengaged from the free cam follower 56 owing to the action of the release spring 74 to rotate toward the released position as illustrated in FIG. 3.

From the preceding description, it will be understood that the spring 102 assists the piston 76 to move in the second direction toward the recessed position. This action of the spring 102 ensures quick movement of the lever 70 to the released position thereof immediately after the rocker arm 34 rests again.

Figure 14:
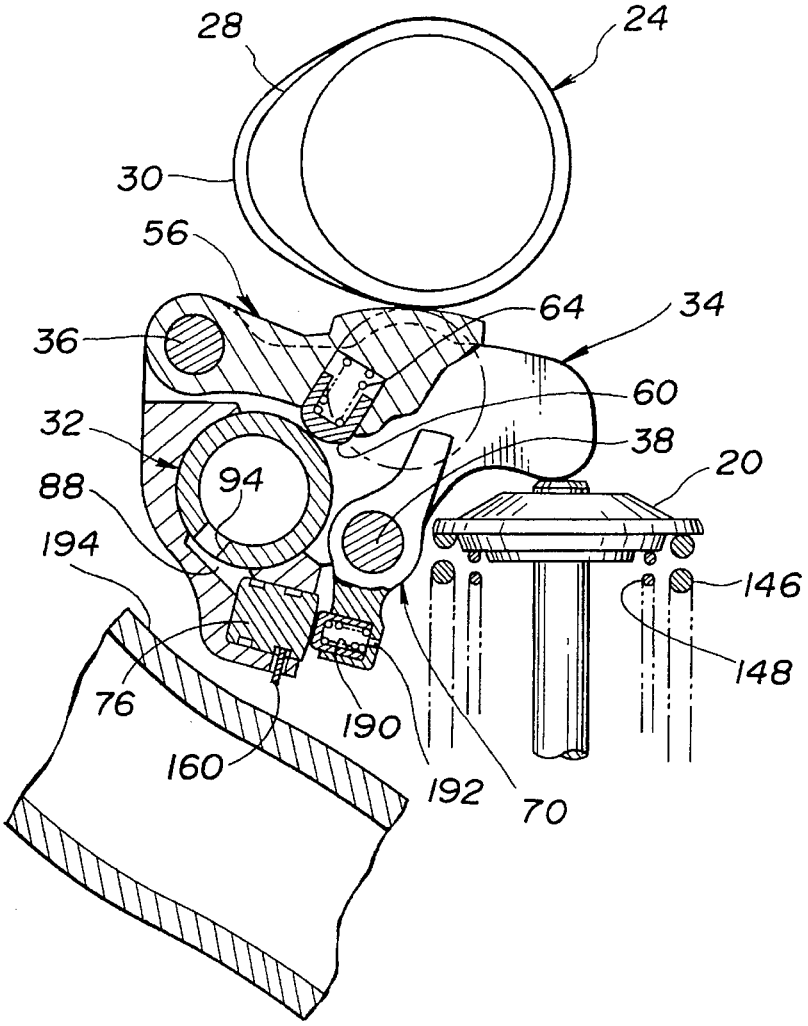
FIG. 14 is a similar view to FIG. 3 showing a second embodiment of a cylinder valve operating apparatus.

Referring to FIG. 14, the second embodiment illustrated herein is substantially the same as the first embodiment previously described except the manner of mounting a cup 98. The cup 98 is slidably received in a blind ended bore 190 with which a lever 70 is formed. A spring 102 is mounted within the blind bore 190 and acts between the blind end of the bore 190 and the cup 98 to keep the cup 98 in contact with a piston 76. The lever 70 is formed with an air vent hole 192 communicating with the blind ended bore 190 for smooth motion of the cup 98. In this embodiment, it is not needed to drill a blind bore in the piston 76. This allows the use of the piston 76 of the reduced diameter, making contribution to miniturization of rocker arm 34. This design is particularly advantageous in installing the rocker arm 34 within an area where an intake pipe 194 extends just below the rocker shaft 32.

From the preceding description of the first and second embodiments, it will now be appreciated that the latch 160 restrains motion of the piston 76 until the rocker arm 34 is lifted, ensuring fail-free and noiseless engagement and disengagement of the lever 70 with and from the free cam follower 56.

It will also be appreciated that the force to be applied to the piston 76 in moving the lever 70 against the action of the release spring 74 is small. Thus, in the first embodiment, a reduced in wall thickness and weight piston is allowed to be used as the piston 76. Due to the use of the light weight piston 76, the inertia mass of the piston 76 and lever 70 system is reduced, thus providing improved response of the lever 70. This allows a shift of the lever 70 during operation of the engine at high speeds.

It will further be appreciated that, in the first embodiment, the piston 76 has received therein the cup 98 and disposed adjacent the axis of rotation of the rocker arm 34 and thus the inertia mass opposing to the motion of the rocker arm 34 is reduced.

What is claimed is:

1. A cylinder valve operating apparatus comprising:

a camshaft with at least one set of cams, including a first cam and a second cam;

a rocker shaft having a latch release cam;

a rocker arm supported by said rocker shaft and driven by said first cam for rotatable motion about said rocker shaft, the rocker arm having a chamber;

a free cam follower supported by said rocker arm and driven by said second cam for rotatable motion relative to said rocker arm;

a lever supported by said rocker arm, said lever being movable to a locked position where said lever is in driving engagement with said free cam follower to provide a positive motion connection between said free cam follower and said rocker arm and to a released position where said lever is out of driving engagement with said free cam follower to provide relative motion of said free cam follower to said rocker arm;

a release spring for biasing said lever toward said released position;

a piston received in said chamber of said rocker arm, wherein the piston is adapted to move in a first direction tending to protrude out of said chamber in response to application of hydraulic fluid pressure in said chamber;

hydraulic means for controlling supply and discharge of hydraulic fluid to and from said chamber;

a latch operatively connected to said rocker arm, said latch having a cam follower finger adapted to cooperate with said latch release cam;

a cup positioned between said piston and said lever, wherein the piston is adapted to move said lever in said first direction toward said locked position against said release spring; and a motion assisting spring positioned between said piston and said lever to assist said piston in moving toward a second direction opposite to said first direction subsequent to the piston moving in said first direction.

2. A cylinder valve operating apparatus as claimed in claim 1, wherein said rocker arm is formed with a slot opening to said chamber, and wherein said piston has a cylindrical peripheral wall covering said slot.

3. A cylinder valve operating apparatus as claimed in claim 2, wherein said latch is adapted to enter said slot and wherein said piston has within said cylindrical peripheral wall thereof spaced first and second grooves adapted to receive said latch.

4. A cylinder valve operating apparatus as claimed in claim 3, wherein said latch enters said first groove of said piston to prevent the motion of said piston in said first direction from a recessed position of said piston, while said latch enters said second groove of said piston to limit the motion of said piston in said second direction from a protruded position of said piston.

5. A cylinder valve operating apparatus as claimed in claim 4, further including latch spring means for biasing said latch into engagement with said cylindrical wall of said piston, while keeping said cam follower finger in slidable contact with said latch release cam.

6. A cylinder valve operating apparatus as claimed in claim 3, wherein said rocker arm is formed with an opening through which said cam follower finger enters into cooperation with said latch release cam.

7. A cylinder valve operating apparatus as claimed in claim 6, wherein said latch release cam has an elevated portion remotest from an axis of said rocker shaft about which said rocker arm rotates, said elevated portion is adapted to contact said cam follower finger when said rocker arm pivots to move said latch to a latch released position where said latch is disengaged from said first and second grooves.

8. A cylinder valve operating apparatus as claimed in claim 7, wherein said piston is formed with a blind bore with an open end adjacent to said lever, and wherein said cup is slidably received in said blind bore, and said motion assisting spring is received in said blind bore and acting between the blind end of said blind bore and said cup to keep said cup in contact with said lever.

9. A cylinder valve operating apparatus as claimed in claim 8, wherein said cup is formed with an air vent hole communicating with said blind bore.

10. A cylinder valve operating apparatus as claimed in claim 7, wherein said lever is formed with a blind bore with an open end adjacent to said piston, and wherein said cup is slidably received in said blind bore, and said motion assisting spring is received in said blind bore and acting between the blind end of said blind bore and said cup to keep said cup in contact with said piston.

11. A cylinder valve operating apparatus as claimed in claim 10, wherein said lever is formed with an air vent hole communicating with said blind bore.

* * * * *